US007343128B2

(12) United States Patent
Song et al.

(10) Patent No.: US 7,343,128 B2
(45) Date of Patent: Mar. 11, 2008

(54) IMAGE TRANSFER MEMBER, IMAGE TRANSFER DEVICE AND IMAGE FORMING SYSTEM

(75) Inventors: In-yong Song, Suwon-si (KR); Myung-kook Ahn, Suwon-si (KR); Sang-don Lee, Gwacheon-si (KR); Shinichi Hasatomi, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/280,355

(22) Filed: Nov. 17, 2005

(65) Prior Publication Data

US 2006/0110190 A1 May 25, 2006

(30) Foreign Application Priority Data

Nov. 23, 2004 (KR) ..... 10-2004-0096531

(51) Int. Cl.
*G03G 15/01* (2006.01)

(52) U.S. Cl. ..... 399/302; 399/308; 399/310

(58) Field of Classification Search ..... 399/302, 399/237, 240, 308, 310
See application file for complete search history.

(56) References Cited

U.S. PATENT DOCUMENTS 6,026,269 A * 2/2000 Setoriyama ..... 399/302
6,042,917 A * 3/2000 Schlueter et al. ..... 428/60
6,044,243 A * 3/2000 Hara ..... 399/302
6,922,542 B2 * 7/2005 Mizuno et al. ..... 399/302

FOREIGN PATENT DOCUMENTS

| | | |
|---|---|---|
| JP | 8-160753 | 6/1996 |
| JP | 11-153910 | 6/1999 |
| JP | 11-167294 | 6/1999 |
| JP | 2004-45637 | 2/2004 |
| KR | 97-16852 | 4/1997 |

* cited by examiner

*Primary Examiner*—David M. Gray
*Assistant Examiner*—Geoffrey T Evans
(74) *Attorney, Agent, or Firm*—Roylance, Abrams, Berdo & Goodman, L.L.P.

(57) ABSTRACT

An image transfer member, an image transfer device and an image forming system employing the image transfer member and device are disclosed. The image transfer member comprises a base layer, and a surface layer formed from a semi-conductive material above the base layer to receive the developer image transferred from the photoconductor. The surface layer forms a contact inscribed angle θ in the range of 10° to 50° between the surface thereof and the developer image. The image transfer member has a voltage-current characteristic exhibiting a current density (CD) in the range of 0.6 $\mu A/cm^2 \leqq CD \leqq 1.5\ \mu A/cm^2$ at 1 KV voltage, and a voltage decay characteristic exhibiting a voltage decay time (DT) in the range of 0.4 sec≦DT≦3 sec for the voltage decay from 500 V to 100 V. The present invention avoids a transfer defect such as transfer void produced by breakdown caused when a high bias voltage is applied to a developer image having a high electric charge and to significantly improve the transfer efficiency.

17 Claims, 7 Drawing Sheets

IMAGE TRANSFER MEMBER, IMAGE TRANSFER DEVICE AND IMAGE FORMING SYSTEM

CROSS-REFERENCE TO RELATED APPLICATIONS

This application claims the benefit of Korean Patent Application No. 2004-96531 filed Nov. 23, 2004 in the Korean Intellectual Property Office, the disclosure of which is hereby incorporated by reference in its entirety.

BACKGROUND OF THE INVENTION

1. Field of the Invention

The present invention relates to an image forming apparatus such as wet type electrophotographic printer, which uses a high density liquid developer. In particular, the invention is directed to an image transfer member for use in transferring a developer image between a photoconductor and a final image receiving medium such as a record paper, and to an image transfer device. The invention is also directed to an image forming system employing the image transfer member and the image transfer device.

2. Description of the Related Art

In general, an image forming apparatus such as a color electrophotographic printer forms an electrostatic latent image on each of a plurality of photoconductors such as photoconductive drums, develops the electrostatic latent image on each photoconductor using a developer of a predetermine color, and transfers the developed images to an image receiving medium such as a paper. Such a color electrophotographic printer is classified into a dry type or a wet type depending on the nature of developer used in the printer. A wet type printer uses a liquid developer containing powdered toner mixed with a volatile liquid carrier as developer.

A wet type electrophotographic printer using a liquid developer uses a toner having a particle size in the range of about 0.5 to 5 μm, which not only makes it possible for the printer to produce an image that is superior in image quality compared to an image produced by a dry type printer using powdered toner at the time of developing an electrostatic latent image, but also makes it possible to prevent a user from suffering harm caused by harmful toner dust. For these reasons, the use of wet type electrophotographic printers are gradually increasing.

In order to print out a color image, such a wet type color electrophotographic printer requires an image forming process for each of a plurality of colors, e.g., yellow, cyan, magenta and black. Therefore, in order to increase print-out speed, it is essential to reduce a length of time required for the image forming process for each color.

In order to reduce a length of time for the image forming process, there has been proposed a wet type color electrophotographic printer for forming a color image by one pass process using four photoconductors respectively forming developer images, of which colors are different from each other, and an intermediate or image transfer medium (ITM) such as a conductive belt or drum for transferring the developer images each formed on one of the four photoconductors to a image receiving medium.

In such a printer, the four photoconductors form a first transfer nip while being in contact with the ITM. If the ITM is a belt type, a plurality of first transfer rollers for applying a first bias voltage to the ITM are positioned on the inner surface of the ITM opposite to the outer surface of the ITM which is in contact with each of the four photoconductors, wherein the first bias voltage renders the developer images each formed on one of the four photoconductors to be transferred to the ITM. In addition, a second transfer roller is positioned at one side of the outer surface of the ITM, wherein an image receiving medium is sandwiched between the outer surface and the second transfer roller. The ITM and the second transfer roller form a second nip between them. The second transfer roller applies a second bias voltage to the image receiving medium, wherein the second bias voltage renders the developer images formed on the ITM to be transferred to the image receiving medium.

Therefore, when the ITM rotates, the developer images respectively formed on the individual photoconductors are transferred onto the ITM in an overlapping manner by the first bias voltage of the first transfer rollers in the first transfer nip section, and the developer images overlapped on the ITM are transferred onto the image receiving medium by the second bias voltage of the second transfer roller.

In a similar manner, the wet type color electrophotographic printer forming a color image in a one pass process may employ a conductive belt or drum as the ITM. However, the belt (hereinbelow, referred to as "ITB (Image Transfer Belt)" is more commonly employed than the drum because the former requires a small installation space as compared to the latter and allows the printer be more freely designed.

However, such a wet type color electrophotographic printer employing an ITB requires a high electric force at the time of transferring a developer image formed on a photoconductor to the ITB or an image receiving medium because the developer image contains high density toner particles having a particle size in the range of about 0.5 to 5 μm and electrified with a high electric charge in the range of about 2 to 10 times of the electric charge of dry type developer (50 μC/g), that is, with a high electric charge in the range of 100 to 500 μC/g.

For example, in order to transfer a developer image formed by a liquid developer having a high electric charge in the range of 100 to 500 μC/g from a photoconductor to an ITB in a narrow first transfer nip, there is typically needed a first bias voltage of not less than about ±1.2 KV. Therefore, the electric potential prior to transferring the developer image from the ITB to an image receiving medium in a second nip will be equal to or higher than about ±400 V. As a result, in order to transfer the developer image from the ITB to the image receiving medium, a second bias voltage of not less than about ±5 KV is needed, whereby the developer image transferred from the ITB to the image receiving medium will contain transfer defects such as transfer voids due to an air gap or breakdown produced depending on the density of the developer image under a high voltage of not less than about ±5 KV and the transfer efficiency will be deteriorated.

Therefore, it is desired to maintain the second bias voltage at a low level not exceeding about ±5 KV in order to prevent the above-mentioned problems. However, if the first bias voltage and/or second bias voltage are lowered not to exceed ±1.2 KV and/or ±5 KV, the electric potential of the developer image transferred to the ITB will be lowered below a proper level needed for transfer or the second bias voltage will not form an electric field needed for transferring the developer image to the image receiving medium, whereby the transfer efficiency will be considerably deteriorated.

Therefore, what is needed to obtain an excellent transfer efficiency is an ITB having electric characteristics which allow a developer image having a high electric charge to be efficiently transferred while allowing the second bias voltage to be maintained in a low level not more than ±5 KV.

In addition, an important parameter that determines transfer efficiency along with the electric property of a developer image such as an electric charge in a wet type electrophotographic printer is the carrier or toner quantity of the developer image, i.e., the density.

Nowadays, a wet type color electrophotographic printer requires a developer delivery system and a density control device, which are complicated, when a low density liquid developer of not more than 3% solids is used. Thus, such a printer becomes complicated or large-sized. Therefore, in order to avoid such a problem, there is a tendency to use a high density developer (for example, of 3 to 20% solids) instead of a low density liquid developer of not more than 3% solids.

With a wet type color electrophotographic printer forming a color image in one pass process as described above, the high density liquid developer is formed on each photoconductor as a developer image having a density, which is typically in the range of 20 to 30% solids. The developer images formed on the individual photoconductors are overlappingly transferred to the ITB in the first transfer nip section and then transferred from the ITB to an image receiving medium in the second transfer nip section.

At this time, the transfer efficiency of a developer image to the image receiving medium is affected by attraction acting between toner particles and the carrier contained in the developer image and surface tension varied depending on an ITB or an image receiving medium, with which the developer image comes into contact. That is, the transfer efficiency of a developer image is greatly affected by the density of the developer image prior to being transferred to an image receiving medium in the second transfer nip section, and the physical property of an ITB for transferring the developer image between a photoconductor and an image receiving medium.

Accordingly, it is required that a developer image be capable of being maintained in a density for allowing the best transfer efficiency to be obtained without causing spreading until the developer image is transferred to an image receiving medium after the developer image has been transferred from a photoconductor in the second transfer nip section. The developer image is also required to have a physical property forming a meniscus for allowing the best transfer efficiency to be obtained when the developer image is transferred from the ITB to the image receiving medium.

Like this, in order to obtain an excellent image which does not cause a transfer defect in a wet type color electrophotographic printer using a high density liquid developer having a high electric charge, the necessity is increased for an ITB, which has electric and physical properties appropriate for transferring a high density developer image having a high electric charge.

SUMMARY OF THE INVENTION

Accordingly, the present invention solves the above-mentioned problems. A principal object of the present invention is to provide an image transfer member, an image transfer device, and an image forming system employing the image transfer member and the image transfer device, which allow an excellent transfer efficiency for a high density liquid developer having a high electric charge to be obtained without producing any transfer defect.

In order to achieve the above-mentioned object, according to an aspect of the present invention, there is provided an image transfer member interposed between a photoconductor formed with a developer image by using a liquid developer and an image receiving medium to transfer the developer image, where the image transfer member comprises: a base layer; and a surface layer formed from a semi-conductive material above the base layer to receive the developer image transferred from the photoconductor, the surface layer having a contact inscribed angle θ in the range of 10° to 50° between the surface thereof and the developer image, and wherein the image transfer member has a voltage-current characteristic exhibiting a current density (CD) in the range of $0.6\ \mu A/cm^2 \leqq CD \leqq 1.5\ \mu A/cm^2$ at 1 KV voltage, and a voltage decay characteristic exhibiting a voltage decay time (DT) in the range of $0.4\ sec \leqq DT \leqq 3\ sec$ for the voltage decay from 500 V to 100 V.

Here, the current density (CD) may be measured by steps of: positioning the image transfer member between a grounded metallic plate and a probe; applying a high voltage to the probe; measuring a mean current value for the applied voltage; and calculating a mean current value per unit area by dividing the measured mean current value by the area of the probe. In addition, the voltage decay time (DT) may be measured by steps of: positioning the image transfer member between a grounded metallic plate and a probe; applying a high voltage to the probe; instantly cutting off the high voltage applied to the probe after a predetermined length of time has passed; and measuring the voltage for a predetermined length of time after the high voltage has been cut off to calculate the time required until the voltage arrives at a target level.

The surface layer is preferably formed from a mixture of an acrylic resin, fluorine and a conductive powder. It is preferable that the surface layer has a thickness in the range of 1 to 20 μm and an elastic modulus in the range of 50 to 200 MPa.

The base layer is preferably formed from polyurethane resin and conductive powders. It is preferable that the base layer has a thickness in the range of 100 to 400 μm and an elastic modulus not less than 1,000 MPa.

The image transfer member of the invention may further comprise an elastic layer interposed between the surface layer and the base layer, wherein the elastic layer is formed from polyurethane rubber and a conductive layer. At this time, the conductive powders preferably comprise carbon black. In addition, it is preferable that the elastic layer has a thickness in the range of 100 to 400 μm and an elastic modulus in the range of 1 to 50 MPa.

It is preferable if the image transfer member may have electric resistance in the range of 1 to 100 MΩ at 500 V.

According to another aspect of the present invention, there is provided an image transfer device comprising: an image transfer member for transferring a developer image between a photoconductor for forming the developer image by using a liquid developer and an image receiving medium; a first transfer member for applying a first bias voltage to the image transfer member so that the developer image formed on the photoconductor is transferred to the image transfer member; and a second transfer member for a second bias voltage to the image receiving medium so that the developer image transferred to the image transfer member is transferred to the image receiving medium, wherein the image transfer member comprises: a base layer; and a surface layer formed from a semi-conductive material above the base layer to receive the developer image transferred from the photoconductor, the surface layer having a contact inscribed angle θ in the range of 10° to 50° between the surface thereof and the developer image, and wherein the image transfer member has a voltage-current characteristic exhibiting a current density (CD) in the range of 0.6 $\mu A/cm^2 \leqq CD \leqq 1.5$ $\mu A/cm^2$ at 1 KV voltage, and a voltage decay characteristic exhibiting a voltage decay time (DT) in the range of 0.4 $sec \leqq DT \leqq 3$ sec for the voltage decay from 500 V to 100 V.

In the inventive image transfer device, the surface layer is preferably formed from acrylic resin, fluorine and conductive powders such as carbon black. The base layer may be formed from polyurethane resin and conductive powders such as carbon black.

In the inventive image transfer device, the image transfer member may further comprise an elastic layer interposed between the surface layer and the base layer, wherein the elastic layer is formed from polyurethane rubber and a conductive layer. It is preferable that the image transfer member has electric resistance in the range of 1 to 100 MΩ at 500 V.

According to another aspect of the present invention, there is provided an image forming system comprising: an image forming unit comprising: a developer storage space for storing a liquid developer, a photoconductor for forming an electrostatic latent image, and a developer transferring body rotating in face of the photoconductor to transfer the liquid developer fed from the developer storage space to the photoconductor in such a way that a visible developer image is formed on the photoconductor according to the electrostatic latent image; and an image transfer unit comprising: an image transfer member for receiving the developer image transferred from the photoconductor, a first transfer member for applying a first bias voltage to the image transfer member so that the developer image formed on the photoconductor is transferred to the image transfer member, and a second transfer member for a second bias voltage to the image receiving medium so that the developer image transferred to the image transfer member is transferred to the image receiving medium, wherein the image transfer member comprises: a base layer, and a surface layer formed from a semi-conductive material above the base layer to receive the developer image transferred from the photoconductor, the surface layer having a contact inscribed angle θ in the range of 10° to 50° between the surface thereof and the developer image, and wherein the image transfer member has a voltage-current characteristic exhibiting a current density (CD) in the range of 0.6 $\mu A/cm^2 \leqq CD \leqq 1.5$ $\mu A/cm^2$ at 1 KV voltage, and a voltage decay characteristic exhibiting a voltage decay time (DT) in the range of 0.4 $sec \leqq DT \leqq 3$ sec for the voltage decay from 500 V to 100 V.

In the inventive image forming system, the surface layer may be formed from a mixture of acrylic resin, fluorine and conductive powders such as carbon black. The base layer may be formed from polyurethane resin and conductive powders such as carbon black.

In the inventive image transfer system, the image transfer member may further comprise an elastic layer interposed between the surface layer and the base layer, wherein the elastic layer is formed from polyurethane rubber and a conductive layer. In addition, preferably the image transfer member has an electric resistance in the range of 1 to 100 MΩ at 500 V.

BRIEF DESCRIPTION OF THE DRAWINGS

The above aspects and features of the present invention will be more apparent from the description for certain embodiments of the present invention taken with reference to the accompanying drawings, in which.

DETAILED DESCRIPTION OF THE PREFERRED EMBODIMENTS

Hereinbelow, an image transfer member and an image transfer device according to the present invention and an image forming apparatus including the image transfer member and device will be described in more detail with reference to the accompanying drawings.

Figure 1:
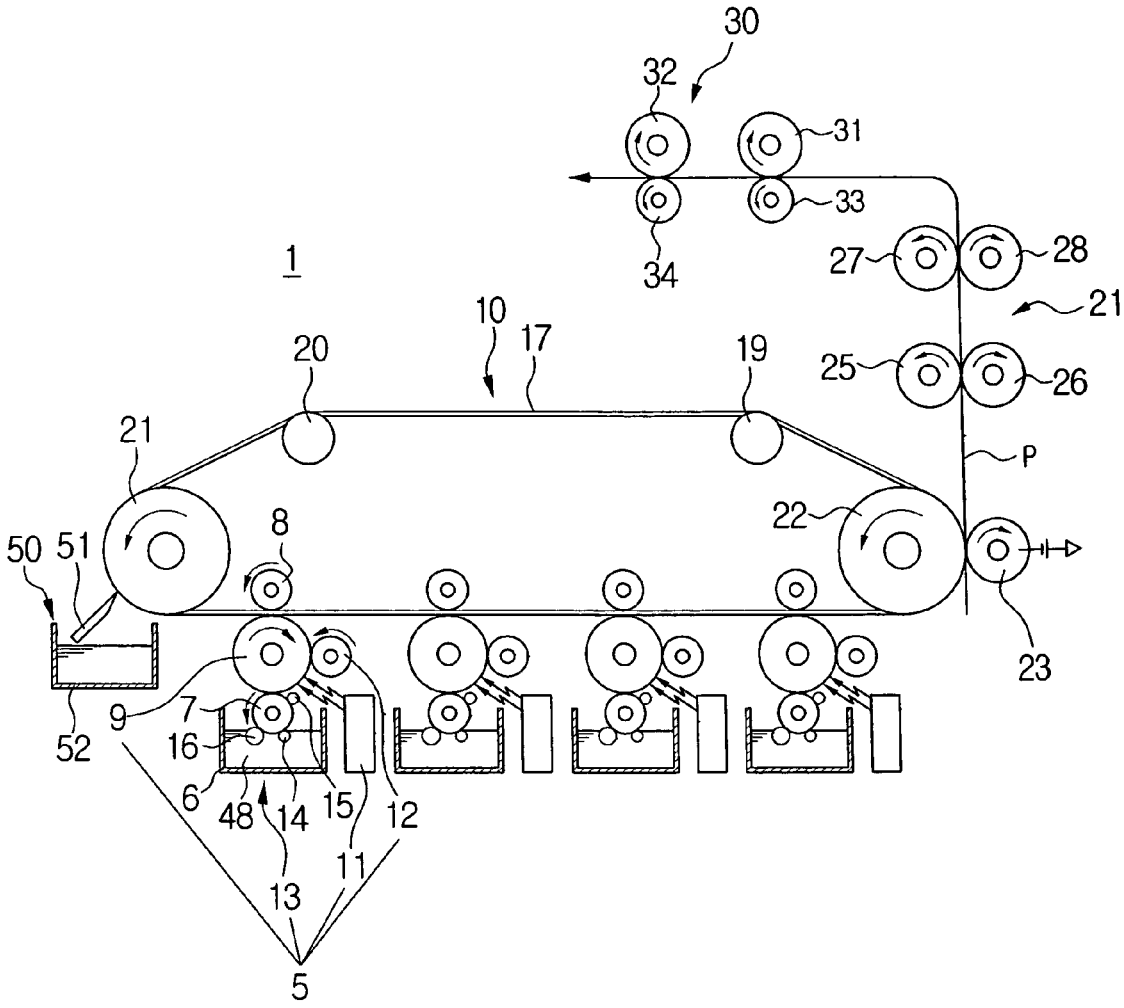
FIG. 1 is a schematic view of a wet type electrophotographic printer, to which the inventive image transfer belt is applied.

FIG. 1 shows a wet type color electrophotographic printer using a liquid developer including an image transfer belt (ITB), which is an image transfer member (ITM).

As shown in FIG. 1, a wet type color electrophotographic printer 1 includes an image forming unit 5, an image transfer unit 10, a fixing unit 21, a paper-discharge unit 30, and a cleaning unit 50.

The image forming unit 5 includes four scanning units 11, four electrification rollers 12, four photoconductors 9, and four developing devices 13 for forming images of multiple colors, e.g., yellow (Y), magenta (M), cyan (C) and black (B).

Figure 2:
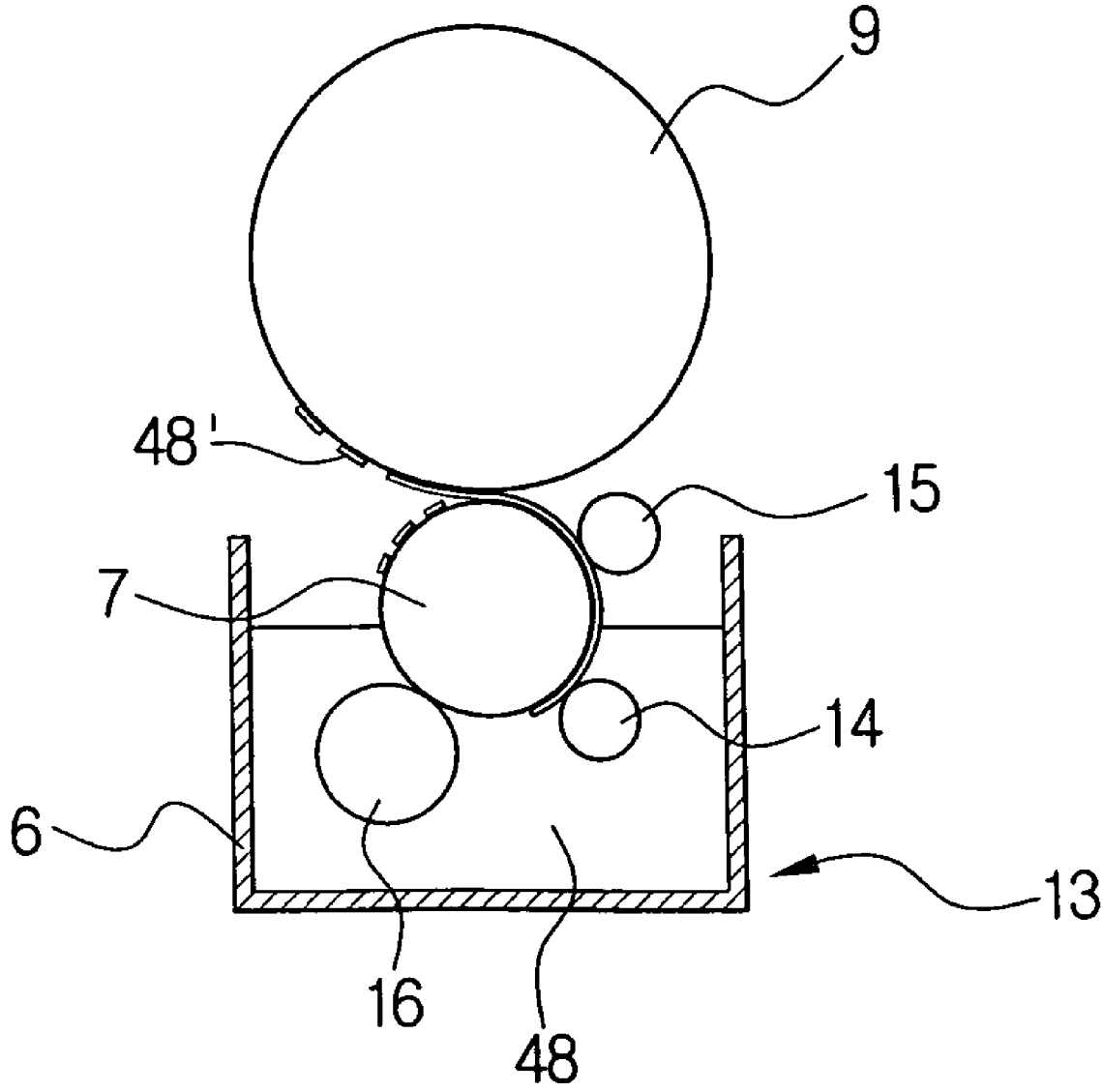
FIG. 2 is a schematic view exemplifying a developing device and an photoconductor of the wet type color electrophotographic printer shown in FIG. 1.

As shown in FIG. 2, each developing device 13 comprises a storage unit 6, a developing roller 7, a deposit roller 14, a metering roller 15, and a cleaning roller 16. The storage unit 6 contains a liquid developer 48. The liquid developer 48 is a liquid developer having a predetermined polarity, e.g., positive (+) polarity, wherein the liquid developer is prepared from hydrocarbon-based liquid carrier formed from Norpar or Isopar and a toner having a particle size in the range of 0.5 to 5 μm. The liquid developer has a density in the range of 3 to 20% by weight solids, preferably in the range of 3 to 15% by weight solids, and an electric charge in the range of 100 to 500 μC/g, preferably in the range of 100 to 200 μC/g. The developing roller 7 serves as a developer transferring body and is located below the corresponding photoconductor 9. The deposit roller 14 is located below the developing roller 7 and applies electric force to the liquid developer 48 to form an electrified developer layer on the developing roller 7. The metering roller 12 applies a predetermined level of voltage to the electrified developer layer formed on the developing roller 7 by the deposit roller 14, thereby to allow more toner to be deposited on the developing roller, wherein the metering roller 12 restrains the electrified developer layer to have a predetermined toner quantity or density, for example, a density in the range of 20 to 30% by weight solids and a toner quantity (M/A) in the range of 100 to 300 $\mu g/cm^2$, preferably in the range of 150 to 250 $\mu g/cm^2$, and delivers the electrified developer layer to a nip between the developing roller 7 and the corresponding photoconductor 9. The cleaning roller 16 cleans the developing roller 7.

The four photoconductors 9 are respectively formed in organic photoconductive drums and serially arranged. Each photoconductor 9 is formed with an electrically charged layer corresponding to a color image to be printed, i.e., an electrostatic latent image, by an electrification roller 12 and a scanning unit 11, and the developer of a developer layer, which is formed on a developer roller 7 from the liquid developer 48 contained in a storage unit 6 by a deposit roller 14 and a metering roller 15 in a corresponding developing device 13, is deposited on the photoconductor 9, whereby the photoconductor 9 is formed with a developer image 48', which is different in color from those formed on the other photoconductors 9.

The image transfer unit 10 is comprised of four first transfer rollers 8, a second transfer roller 23 and an ITB 17.

The first transfer rollers 8 are located on the internal surface of the ITB 17, which is opposite to the outer surface of the ITB 17 which is in contact with the photoconductors 9, in such a way that the transfer rollers 8 correspond to the photoconductors 9, respectively. Each first roller 8 supplies a first bias voltage, i.e., an electrostatic driving force to the ITB 17 for transferring a developer image 48' formed on the corresponding photoconductor 9 to the ITB 17 in a first transfer nip section, wherein the first nip is formed between each of the first transfer rollers 8 and the ITB 17.

The second transfer roller 23 is positioned at a side of the ITB 17 to form a second nip with the ITB 17 with an image receiving medium P being sandwiched between the ITB 17 and the second transfer roller 23. The second transfer roller 23 applies a second bias voltage to the image receiving medium P for transferring the developer images 48', which have been transferred to the ITB 17 from the photoconductors 9, to the image receiving medium P.

The ITB 17 is turned along a way on an endless track along first, second and third support rollers 19, 20, 21 by a belt driving roller 22.

Therefore, when the ITB 17 turns, the developer images 48' each formed on one of the photoconductors 9 are overlappingly transferred onto the ITB 17 by the first bias voltage applied to the ITB 17 by the first transfer rollers 8, thereby forming an overlapped developer image 48', which is in turn transferred to the image receiving medium P by the second bias voltage applied by the second transfer roller 23.

As described above in the description of prior art, however, if the first bias voltage and the second bias voltage applied to the ITB 17 and the image receiving medium P, respectively, for transferring developer images 48' having a positive polarity and a high electric charge to the ITB 17 and the image receiving medium P in the first and second transfer nip sections, which are narrow, are not less than −1.2 KV and not less than about −5 KV, respectively (in the case of a liquid developer having a negative (−) polarity, not less than +1.2 KV and not less than +5 KV, respectively), transfer void defects may be produced in the developer images 48' transferred to the image receiving medium P from the ITB 17 due to an air gap or breakdown caused depending on the densities of the developer images under a high voltage.

In addition, if the first bias voltage and/or the second bias voltage are lowered to be not more than −1.2 KV and/or not more than −5 KV so as to maintain the second bias voltage in a low level of not more than about −5 KV, the electric potential of the developer images 48' prior to transferring to the image receiving medium P may be lowered below a proper level of electric potential, e.g., +200 V, which is required for transferring the developer images 48,' or the second bias voltage can not form an electric field, which is required for moving the developer images to the image receiving medium, whereby the transfer efficiency is significantly deteriorated.

In order to solve these problems, the inventive ITB 17 is configured to meet with electric characteristics, i.e., a current-voltage characteristic and a voltage decay characteristic as described below.

Figure 5A:
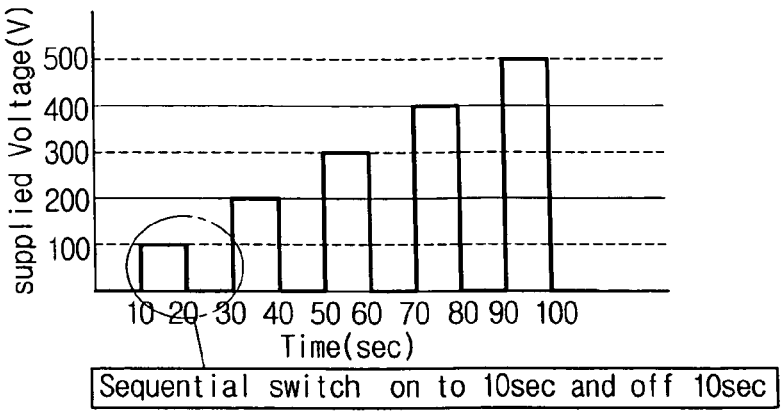
FIGS. 5A to 5C are graphs exemplifying steps of measuring a voltage-current characteristic of the image transfer belt shown in FIG. 3, respectively.
Figure 5B:
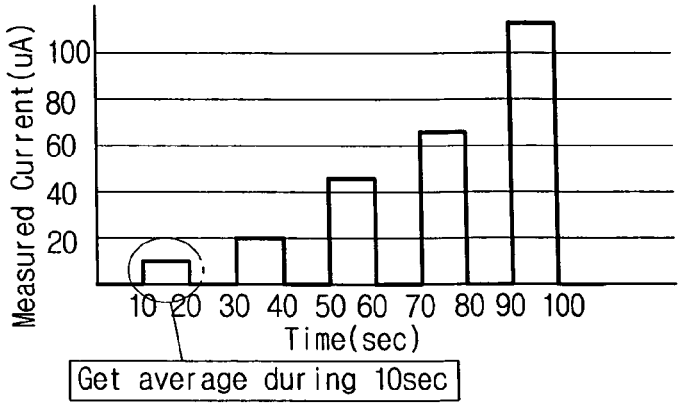
Figure 5C:
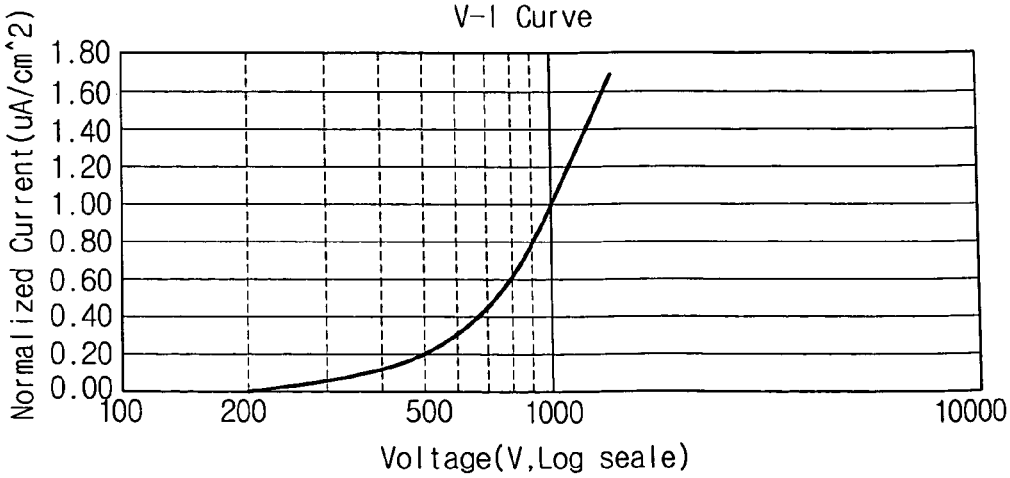
Figure 7A:
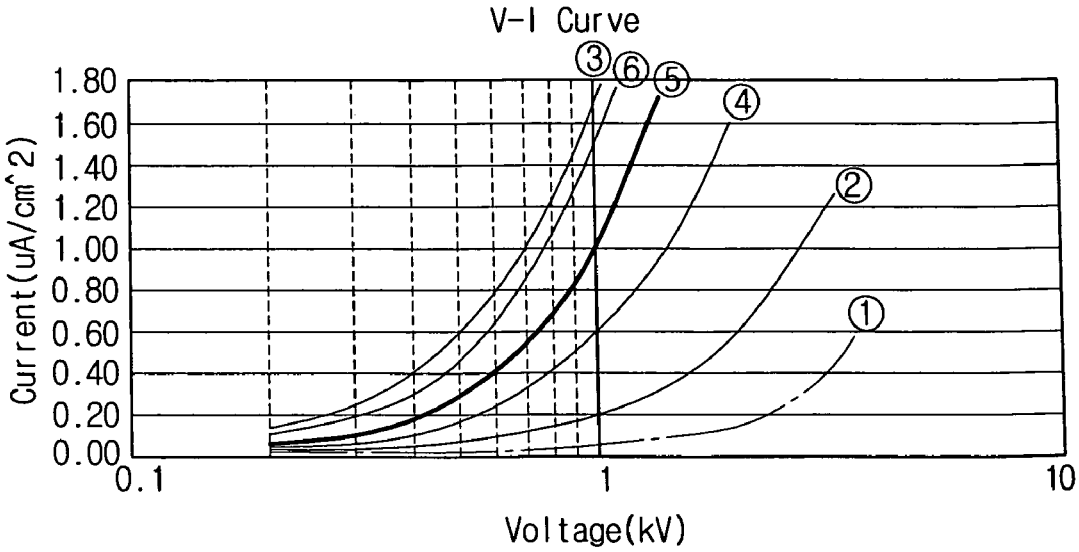
FIGS. 7A and 7B are graphs exemplifying steps of a voltage-current characteristic and a voltage decay characteristic of an image transfer belt of an embodiment of the present invention and that of a comparative embodiment, respectively.

As shown in FIG. 5C and FIG. 7A (curves ④ to ⑥), the voltage-current characteristic of the ITB 17 exhibits a curve expressed by a following cubic polynomial equation (1), in which the current density (CD) is in the range of 0.6 $\mu A/cm^2 \leqq CD \leqq 1.5\ \mu A/cm^2$, preferably in the range of 0.8 $\mu A/cm^2 \leqq CD \leqq 1.2\ \mu A/cm^2$, at 1 KV voltage.

$$I=a*(V)^3+b*(V)^2+c*(V)+d \quad (1)$$

wherein I is current, V is voltage, and a, b, c and d are constants.

The voltage-current curves (V-I curves) were obtained by a method described below. At first, the ITB 17 is interposed between a grounded metallic plate and a probe. Next, a high voltage, which is sequentially increased in terms of 100 V, is intermittently supplied to the probe using a high voltage supply (for example, Model 610D available from Trek Inc.) in such a way that the voltage is applied for 10 seconds and then cut off for 10 seconds as shown in FIG. 5A, and then a mean current value for each voltage applied for 10 seconds is measured using a surface potential meter (for example, Model 310 available from Trek Inc.) as shown in FIG. 5B. The reason why each voltage-applying period continues for 10 seconds and then a voltage cut-off period following each voltage applying period continues for 10 seconds equal to the time length of each voltage-applying period (or more), is to keep the repeatability of measurement. Then, each mean current value for 10 seconds is divided by the area of the probe to obtain a mean current value per unit area and a voltage-current curve as shown in FIG. 5C is prepared on the basis the obtained mean current values and the voltages.

Figure 6A:
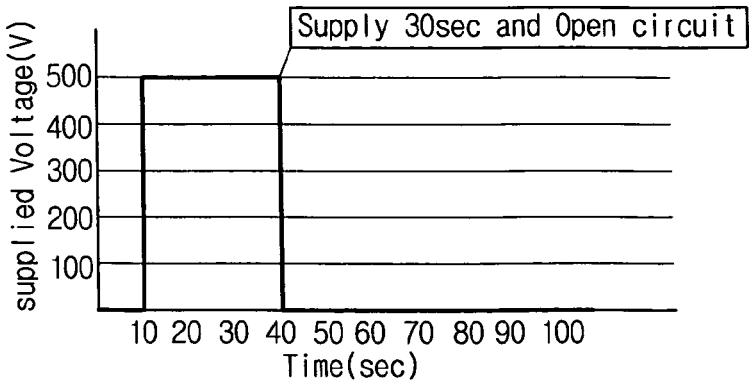
FIGS. 6A to 6C are graphs exemplifying steps of measuring a voltage decay characteristic of the image transfer belt shown in FIG. 3, respectively.
Figure 6B:
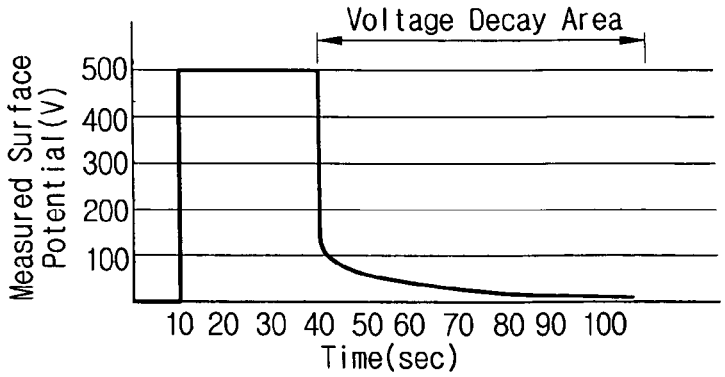
Figure 6C:
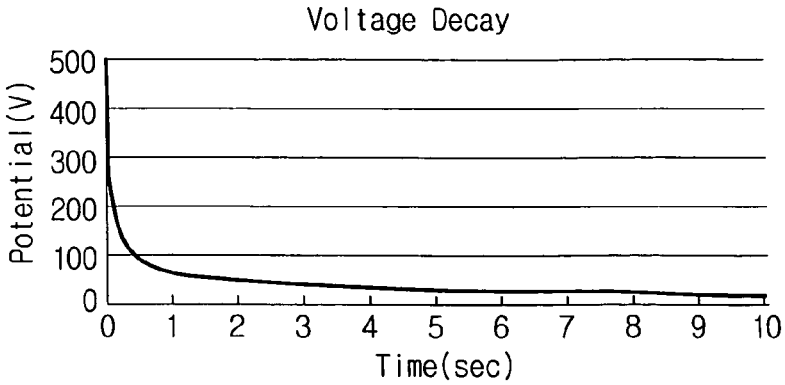
Figure 7B:
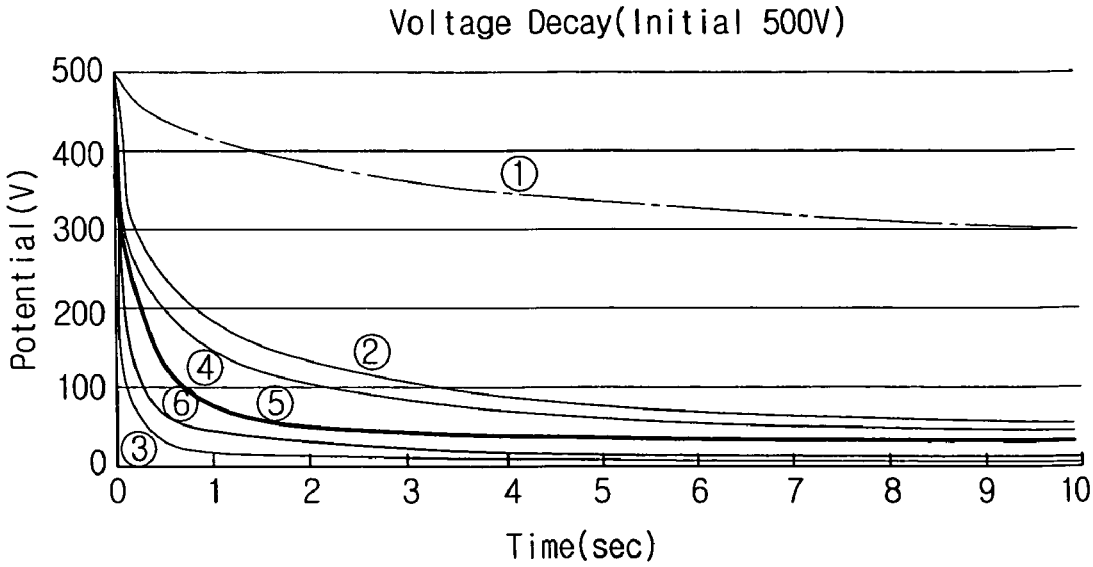

Next, as shown in FIG. 6C and FIG. 7B (curves ④ to ⑥), the voltage decay characteristic of the ITB exhibits a curve characteristic having a voltage decay time (DT) in the range of 0.4 sec$\leqq$DT$\leqq$3 sec for the voltage decay from 500 V to 100 V.

At this time, the voltage decay curves were obtained in the following manner. At first, the ITB 17 is interposed between the grounded metallic plate and the probe. Then, using a high voltage supply (for example, Model 610D available from Trek Inc.), a high voltage of 500 V is applied to the probe for 30 seconds and then, the voltage supply is instantly cut off, that is, the high voltage terminal of the high voltage supply is removed from the probe, as shown in FIGS. 6A and 6C. Then, the voltage is measured for 10 seconds using Model 310 available from Trek Inc. as shown in FIG. 6C. Thereafter, a voltage decay curve is prepared on the basis of the measured voltage.

If the current density (CD) is not more than 0.6 $\mu A/cm^2$ and the voltage decay time (DT) is not less than 3 sec, the electric potential prior to transferring a developer image from the ITB 17 to the image receiving medium P is increased to +250 V or more and thus the second bias voltage is required to be not less than about −4 KV, whereby the potential of producing transfer void defects caused by breakdown is increased.

If the current density (CD) is not less than 1.5 $\mu A/cm^2$ and the voltage decay time (DT) is not more than 0.4 sec, the electric potential prior to transferring a developer image from the ITB 17 to the image receiving medium P is lowered below a proper level needed for image transfer, i.e., +200 V, whereby the transfer efficiency is deteriorated.

The ITB 17 fabricated to meet with the above-mentioned current-voltage characteristic and voltage decay characteristic is enabled to use a first bias voltage of not more than −1.2 KV, preferably in the range of −0.6 KV to −1 KV so as to transfer a developer image of positive polarity having a high electric charge in the range of 100 to 500 μC/g from a photoconductor 9 to the ITB 17 within a narrow first transfer nip section, whereby the electric potential of the developer image prior to transferring from the ITB 17 to the image receiving medium within a second transfer nip will be in the range of +200 V to 250 V. As a result, it is enabled to use a second bias voltage of not more than −4 KV, preferably in the range of −2.5 KV to −4 KV so as to transfer the transfer the developer image from the ITB 17 to the image receiving medium P, whereby the developer image transferred from the ITB 17 to the image receiving medium P will not exhibit any transfer void defect produced due to breakdown caused when a voltage of not less than about −5 KV is applied. In addition, because the electric potential of the developer image prior to transferring from the ITB 17 to the image receiving medium P in the second transfer nip is maintained in the range of +200 V to +250 V, the cause of the deterioration of transfer efficiency is avoided.

Figure 3:
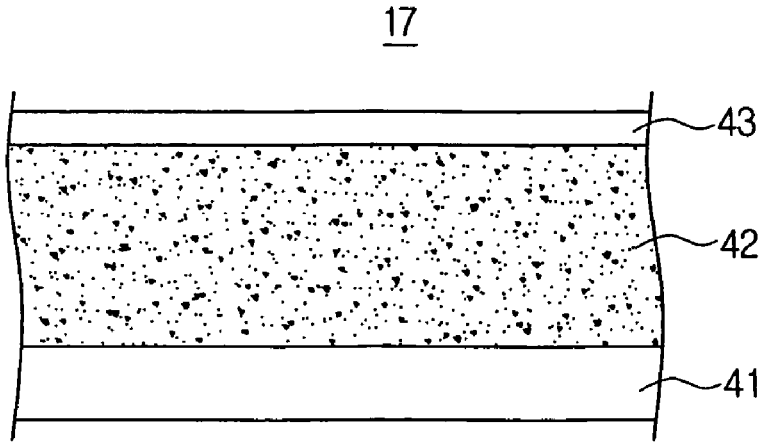
FIG. 3 is a partial side view of an image transfer belt of the wet type color electrophotographic printer shown in FIG. 1.

In order to meet the above-mentioned current-voltage characteristic and voltage decay characteristic, the inventive ITB 7 is formed in a three layer structure comprising a base layer 41, an elastic layer 42 and a surface layer 43 as shown in FIG. 3.

The base layer 41 serves to keep the durability and life span; the base layer 41 is formed by adding conductive powders into polyurethane resin. Carbon black is preferably used as the conductive powder. It is preferable that the base layer 41 has a thickness in the range of about 100 μm to 400 μm and an elastic modulus of not less than about 1,000 MPa.

The elastic layer 42 serves to enhance the transfer efficiency by facilitating the contact between a developer layer and a image receiving medium P when the developer layer transferred to the ITB 17 is transferred to the image receiving medium P; the elastic layer 42 is positioned on the base layer 41 and formed by adding conductive powders into polyurethane rubber. Here, carbon black may be preferably used as the conductive powders. It is preferable that the elastic layer 42 has a thickness in the range of about 100 μm to 400 μm and an elastic modulus in the range of 1 to 50 MPa.

The surface layer 43 is positioned on the elastic layer 42; the surface layer 43 is formed by mixing fluorine, conductive powders and a soft hardening agent with acrylic resin such as acryl resin so as to enhance the cleaning performance of the ITB 17 and the compliance of an image receiving medium, in particular the transfer efficiency. Here, carbon black may be preferably used as the conductive powders. The surface layer 43 preferably has a thickness in the range of about 1 μm to 20 μm, preferably in the range of about 5 μm to 10 μm, and an elastic modulus in the range of about 50 to 200 MPa.

The reason why the surface layer 43 is formed by adding fluorine into the acrylic resin is as follows.

As described in the description of prior art above, beyond the electric property of a developer image, the toner or carrier quantity in the developer image, i.e., the density, is also an important parameter for determining the transfer efficiency in a wet type color electrophotographic printer. Through experiments, it was founded that the best transfer efficiency can be obtained when a developer image 48' formed on the ITB 17 prior to being transferred to an image receiving medium P has a density (% solids) in the range of about 25 to 35% by weight solids. Therefore, in order to obtain the density in the range of about 25 to 35% by weight solids in a developer image 48' prior to transferring the developer image, it is important that the density shall be maintained in the above-mentioned range until the developer image is transferred to the image receiving medium P after the developer image has been formed in a photoconductor 9. For this purpose, the inventive ITB 17 has a surface layer 43 formed by adding a predetermined amount of fluorine into the acrylic resin, in such a way that the contact inscribed angle θ between the surface layer 43 and a developer image 48' transferred onto the surface layer 43 has an extent of 10° to 50°. The contact inscribed angle θ in this range serves to prevent the developer image 48' from spreading from the ITB 17 thereby keeping the density of the transferred developer image 48' in the range of about 25 to 35% by weight solids at its maximum, and to allow a preferred meniscus to be formed in the developer image 48' when the developer image 48' is transferred from the ITB 17 to the image receiving medium P in the second transfer nip, thereby enhancing the transfer efficiency.

The ITB 17 formed in the three layer structure as described above has a total thickness in the range of about 400 to 1,000 μm.

Although it has been exemplified and described above that the inventive ITB 17 of the image transfer unit 10 is formed in a three layer structure in such way that the ITB 17 has a voltage-current characteristic exhibiting a current density in the range of 0.6 $\mu A/cm^2 \leqq CD \leqq 1.5\ \mu A/cm^2$ at 1 KV voltage, and a voltage decay characteristic exhibiting a voltage decay time (DT) in the range of 0.4 sec$\leqq$DT$\leqq$3 sec for the voltage decay from 500 V to 100V, the present invention is not limited to this. For example, the ITB 17 of the image transfer unit 10 may be formed either in a two layer structure that meets with the above-mentioned voltage-current characteristic and voltage decay characteristic and has a base layer and a surface layer, or in a multi-layer structure that meets with the above-mentioned voltage-current characteristic and voltage decay characteristic and has more than three layers.

In addition, it is preferable that the ITB 17 has an electric resistance in the range of 1 to 10 MΩ at 500 V. If the electric resistance of the ITB 17 is not more than 1 MΩ, the conductivity of the ITB 17 is so high that the current will flow through the first and second nips, and thus, first and second bias voltages will not be properly formed. If the electric resistance of the ITB 17 is not less than 100 MΩ, the intensity of the electric field generated by the first and second bias voltages are reduced in inverse proportion to the increase of the thickness of the ITB 17, and thus, the transfer efficiency is deteriorated.

Referring to FIG. 1 again, the fixing unit 21 comprises first and second heating rollers 25, 27 and first and second compression rollers 26, 28. The first and second rollers 25, 27 apply heat to a developer image 48' transferred to an image receiving medium P and the first and second compression rollers 26, 28 compress the image receiving medium P against the first and second heating rollers 25, 27 with a predetermined pressure. The image receiving medium P having the developer image 48' fixed by the heat and pressure applied by the first and second heating rollers 25, 27 and the first and second compression rollers 26, 28 is discharged out of the printer by the first and second paper-discharge rollers 31, 32 and the first and second paper-discharge backup rollers 33, 34 of the paper-discharge unit 30.

The cleaning unit 50 comprises a cleaning blade 51 for removing the developer image remaining on the ITB 17, and a waste developer sump 52 for containing waste toner removed by the cleaning blade 51.

Although it has been exemplified and described above that the inventive wet type color electrophotographic printer 1 employs an ITB as an ITM, the present invention is not limited to this. In other embodiments, the inventive printer 1 can be configured in such a way that conductive drums identical in principle and construction to the above-mentioned ITB can be employed.

The wet type color electrophotographic printer 1 configured as described above and having the inventive ITB operates as follows.

At first, as a print command is issued, the image forming unit 5 actuates individual components thereof to perform a series of image forming operations for forming four colors.

An electrostatic latent image corresponding to a color image to be printed is formed on each photoconductor 9 by an electrification roller 12 and a laser scanning unit 11 A developer layer, which has been formed on a corresponding developing roller 7 from the liquid developer 48 contained in a storage unit 6 by a deposit roller 14 and a metering roller 15 is deposited on the electrostatic image-formed area on the photoconductor 9, thereby forming a developer image 48'. The liquid developer 48' has a predetermined density and a predetermined toner quantity, for example, a density in the range of 20 to 30% solids and a toner quantity (M/A) in the range of 100 to 300 $\mu g/cm^2$, and preferably in the range of 150 to 250 $\mu g/cm^2$.

At this time, a liquid developer of a proper polarity, e.g., positive (+) polarity, which has a density in the range of 3 to 20% solids, for example, and an electric charge in the range of 100 to 500 $\mu C/g$, preferably in the range of 100 to 200 $\mu C/g$, is used as the liquid developer 48. The liquid developer 48 is formed as an electrified developer layer on the developer roller 7 by the electric force of the deposit roller 14, which developer layer is formed as a developer layer on a corresponding photoconductor 9 as a predetermined level of voltage is applied by the metering roller 15, wherein the developer layer formed on the photoconductor has a density of 20 to 30% by weight solids and a toner quantity (M/A) in the range of 100 to 300 $\mu g/cm^2$.

The developer images 48' each developed on a corresponding photoconductor 9 by a corresponding developing device 13 are overlapped and transferred onto the ITB from the photoconductors 9 by the first bias voltage and pressure applied by the first transfer rollers 8 located inside of the ITB 17, thereby forming an overlapped developer image 48'. The overlapped developer image 48' on the ITB 17 is moved to the second transfer roller 23 as the ITB is turned along the first, second and third support rollers 19, 20, 21 by the belt driving roller 22, and then the overlapped developer image 48' is transferred to an image receiving medium P by the voltage and pressure applied by the second transfer roller 23.

At this time, since the ITB 17 has a voltage-current characteristic exhibiting a current density (CD) in the range of 0.6 $\mu A/cm^2 \leqq CD \leqq 1.5\ \mu A/cm^2$ at 1 KV voltage, and a voltage decay characteristic exhibiting a voltage decay time (DT) in the range of 0.4 sec$\leqq$CD$\leqq$3 sec for the voltage decay from 500 V to 100 V, a voltage of not more than −1.2 KV, preferably in the range of −0.6 to −1 KV is used as the first bias voltage, whereby the electric potential of the developer image 48' prior to transferring to the image receiving medium P from the ITB 17 in the second nip will be in the range of +200 V to 250 V. As a result, a voltage of not more than −4 KV, preferably in the range of −2.5 KV to −4 KV, is used as the second bias voltage for transferring the developer image to the image receiving medium P from the ITB 17, whereby the developer image transferred to the image receiving medium P from the ITB 17 does not exhibit a transfer void defect caused by breakdown.

Figure 4:
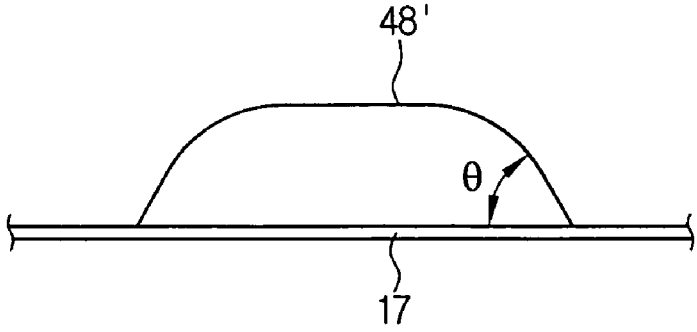
FIG. 4 is a partial side view exemplifying a contact inscribed angle θ between the surface of the image transfer belt shown in FIG. 3 and a developer image.

In addition, as shown in FIG. 4, since the ITB 17 is formed in such a way that the contact inscribed angle θ between the surface layer 43 thereof and the developer image 48' transferred to the surface layer 43 is formed in the range of 10° to 50°, the transferred developer image 48' will not be spread from the ITB, whereby it is possible to keep the density of the developer layer 48' in the range of 20 to 35% by weight solids and a preferred meniscus is formed when the developer image 48' is transferred to the image receiving medium P, thereby improving the transfer efficiency.

The developer image 48' transferred to the image receiving medium P is fixed on the image receiving medium P by the first and second heating rollers 25, 27 and the first and second compression rollers 26, 28, thereby finally forming a desired image.

Then, the image receiving medium P is discharged out of the printer by the first and second paper-discharge rollers 31, 32 and the first and second paper-discharge backup rollers 33, 34 of the paper-discharge unit 30.

After the developer image 48' has been transferred to the image receiving medium P from the ITB 17, the ITB 17 is continuously turned and moved to the cleaning blade 51 which is arranged to be in contact with the outer surface of the ITB at a side of the third support roller 21. The waste developer remaining on the surface layer of the ITB 17 is removed from the ITB 17 by the cleaning blade 51 and recovered to the waste developer sump 52 in order to prepare the next image printing.

After the residual waste toner has been removed, the ITB 17 repeatedly performs the above-mentioned operations through the photoconductors 9, the laser scanning units 11 and the developing devices 13 in order to form a next image.

EXAMPLE

Now, preferred embodiments are described by way of example in order to help better understand the present invention. However, it shall be understood that the following embodiments are provided in order that the present invention can be more easily understood but are not intended to limit the present invention to those embodiments.

As indicated in Table 1 and FIGS. 7A and 7B, three ITBs of Comparative Embodiments (Comparative Embodiment Nos. 1 to 3 corresponding to curves ① to ③ in FIGS. 7A and 7B), which do not meet with the above-mentioned voltage-current characteristic and voltage decay characteristic obtained according to the present invention, and three ITBs of embodiments of the present invention, which meet with the above-mentioned voltage-current characteristic and voltage decay characteristic (Embodiment Nos. 4 to 6 corresponding to curves ④ to ⑥ in FIGS. 7A and 7B), were used for the sake of comparison. At this time, each ITB has a three layer structure comprising a base layer which is formed from polyurethane resin and carbon black and has a thickness of about 250 μm and an elastic modulus of about 1,000 MPa, an elastic layer which is formed from polyurethane rubber and carbon black and has a thickness of about 250 μm and an elastic modulus of about 40 MPa, and a surface layer which is formed from acrylic resin, fluorine and carbon black and has a thickness of about 15 μm and an elastic modulus of about 150 MPa.

TABLE 1

| | Comparative Embodiments | | | Embodiments | | |
|---|---|---|---|---|---|---|
| | No. 1 | No. 2 | No. 3 | No. 4 | No. 5 | No. 6 |
| Current-voltage curve | Curve of cubic and polynomial expression | Equal to left | Equal to left | Equal to left | Equal to left | Equal to left |
| Current density at 1 KV | 0.05 | 0.2 | Not less than 1.5 | 0.6 | 1 | 1.5 |
| Time for voltage decay from 500 to 100 V (sec) | Not less than 10 | Not less than 3 | Not more than 0.4 | Not less than 2, not more than 3 | 0.8 | 0.4 |
| Resistance at 500 V (MΩ) | Not less than 500 | 100 to 500 | Not more than 1 | 1 to 100 | | |

The ITBs having the above-mentioned characteristics (Nos. 1 to 6) were installed in a wet type color electrophotographic printer and printing was performed in the following conditions:

- Liquid developer: a liquid developer of positive (+) polarity consisting of toner having a particle size in the range of 0.5 to 5 μm and hydrocarbon-based liquid carrier formed from Norpar, wherein the liquid developer has a density in the range of 3 to 15% by weight solids and an electric charge in the range of 100 to 200 μC/g;
- Toner quantity (M/A) of a developer layer deposited on a developing roller of a developing device: 150 to 250 $\mu g/cm^2$;
- Density of a developer layer deposited on a developing roller of a developing device: 20 to 30% solids; and
- Image receiving medium: papers having high electric resistance not less than 100,000 MΩ.

Figure 8:
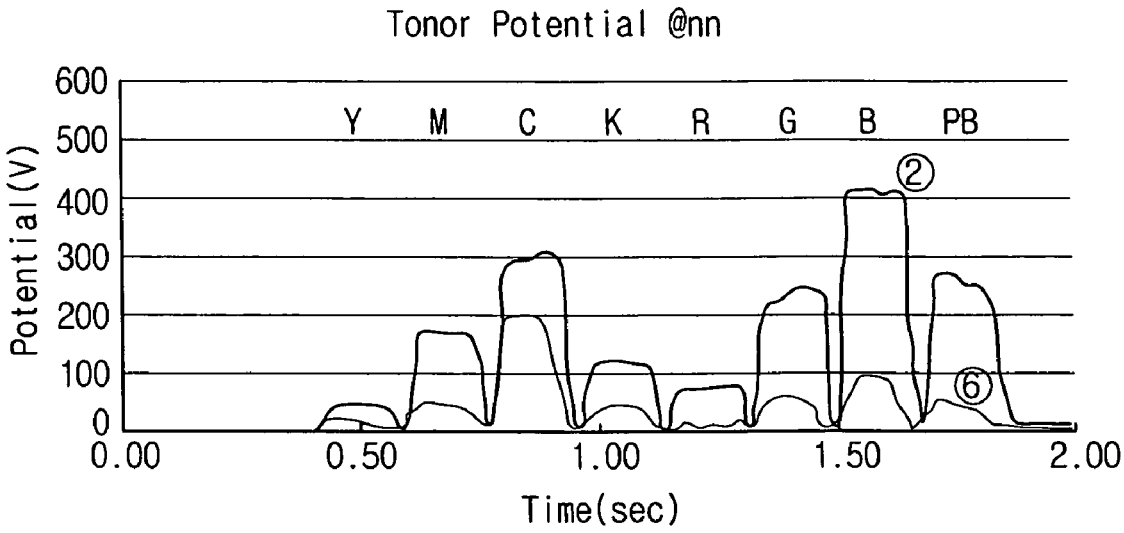
FIG. 8 is a graph exemplifying a potential for each color in a developer image on an image transfer belt of an embodiment of the present invention and that of a comparative embodiment prior to transferring a developer image to an image receiving medium.

As a result, the wet type color electrophotographic printer did not produce any transfer defect such as transfer void and exhibited an excellent image transfer efficiency of not less than 85% for image receiving mediums as indicated in Table 2 when it was mounted with any of the ITBs of the inventive embodiment Nos. 4 to 6. In addition, it can be seen that the maxim electric potential of a developer image prior to being transferred to an image receiving medium P from the ITBs of the inventive embodiment Nos. 4 to 6 in the second transfer nip is in the range of +200 to 250 V. Especially, as a result of measuring the electric potential of a developer image prior to being transferred to an image receiving medium P for individual colors of developer image, i.e., yellow (Y), magenta (M), cyan (C), black (K), red (R), green (G), blue (B) and process black (PB), the ITB of the embodiment No. 6 exhibited the maximum potential of not more than +200 V at cyan (C) as shown in FIG. 8. In addition, when the ITBs of the inventive embodiment Nos. 4 to 6 were mounted in the printer, the first bias voltage and second bias voltage exhibiting the most excellent transfer efficiency were in the range of −0.6 to −1 KV and in the range of −2.5 to −4 KV, respectively.

Whereas, the wet type color electrophotographic printer produced transfer defects such as transfer voids and exhibited a poor image transfer efficiency not more than 80% for image receiving mediums when it was mounted with any of the ITBs of the Comparative Embodiment Nos. 4 to 6. In particular, the ITB of the Comparative Embodiment No. 3 caused a transfer omission. In addition, it can be seen that the maxim electric potential of a developer image prior to being transferred to an image receiving medium P from the ITBs in the second transfer nip is not less than 400 V (Nos. 1 and 2) or not more than +200 (No. 3). Especially, the ITB of the Comparative Embodiment No. 2 exhibited the maximum electric potential of +400 V at blue (B) as shown in FIG. 8. In addition, when the ITBs of the Embodiment Nos. 1 to 3 were mounted in the printer, the first bias voltage and second bias voltage exhibiting the best transfer efficiency were not less than −1.2 KV (Nos. 1 and 2) and not more than −0.4 KV (No. 3), and not less than −4 KV (Nos. 1 and 2) and in the range of −1.5 to −2 KV (No. 3), respectively.

TABLE 2

| | Comparative Embodiments | | | Embodiments | | |
|---|---|---|---|---|---|---|
| | No. 1 | No. 2 | No. 3 | No. 4 | No. 5 | No. 6 |
| Maximum potential of developer image prior to being transferred in second nip (V) | +600 | +400 | Not more than +200 | +200 to +250 | | |
| First bias voltage (KV) | −1.5 | −1.2 | Not more | −1 | −0.8 | −0.6 |

TABLE 2-continued

| | Comparative Embodiments | | | Embodiments | | |
|---|---|---|---|---|---|---|
| | No. 1 | No. 2 | No. 3 | No. 4 | No. 5 | No. 6 |
| Second bias voltage (KV) | Not less than −5 | −4 to −5 | than −0.4 Not less than −1.5, not more than −2 | | −2.5 to −4 | |
| Transfer defect (transfer void) | Poor | Poor | Poor (transfer omission) | Good | Good | Good |
| Image transfer efficiency for an image receiving medium (P) | Not more than 80% | Not more than 80% | Not more than 80% | Not less than 85% | Not less than 85% | Not less than 85% |

As described above, by providing an ITB having a voltage-current characteristic exhibiting a current density (CD) in the range of 0.6≦CD≦1.5 μA/cm2 at 1 KV voltage and a voltage decay characteristic exhibiting a voltage decay time (DT) in the range of 0.4 sec≦CD≦3 sec for the voltage decay from 500 V to 100 V according to the present invention, a low voltage of not more than ±1.2 KV, preferably in the range of ±0.6 to ±1 KV, is used as the first bias voltage, thereby keeping the electric potential of a developer image in the range of ±200 V to ±250 V. As a result, a low voltage of not more than ±5 KV, preferably in the range of ±2.5 KV to ±4 KV, can be used as the second bias voltage, thereby not only preventing transfer defects such as transfer voids caused due to breakdown produced when the second bias voltage is in a high level of not less than ±5 KV but also significantly increasing the transfer efficiency.

In addition, by providing ITB having a contact inscribed angle θ between the surface layer thereof and a developer image in the range of 10° to 50° according to the present invention, a transferred developer image will not be spread from the ITB, whereby it is possible to keep the density of the developer layer in the range of 20 to 35% by weight solids and a preferred meniscus is formed when the developer image is transferred to an image receiving medium, thereby improving the transfer efficiency.

While the preferred embodiments of the present invention have been shown and described in order to exemplify the principle of the present invention, the present invention is not limited to the specific embodiments. It will be understood that various modifications and changes can be made by one skilled in the art without departing from the spirit and scope of the invention as defined by the appended claims. Therefore, it shall be considered that such modifications, changes and equivalents thereof are all included within the scope of the present invention.

What is claimed is:

1. An image transfer member interposed between a photoconductor for forming a developer image using a liquid developer and an image receiving medium to transfer the developer image, said image transfer member comprising:

a base layer; and a surface layer formed from a semi-conductive material above the base layer to receive the developer image transferred from the photoconductor, the surface layer forming a contact inscribed angle θ between the surface thereof and the developer image in the range of about 10° to about 50°, and wherein the image transfer member has a voltage-current characteristic exhibiting a current density (CD) in the range of 0.6 $\mu A/cm^2$ ≦CD≦1.5 $\mu A/cm^2$ at about 1 KV voltage, a voltage decay characteristic exhibiting a voltage decay time (DT) in the range of about 0.4 sec≦DT≦3 sec for the voltage decay from about 500 V to about 100 V, and an electric resistance in the range of about 1 to about 100 MΩ between the base layer and the surface layer when a voltage of about 500 V is applied to either the base layer or the surface layer.

2. An image transfer member as claimed in claim 1, wherein the current density (CD) is measured by steps of:

the image transfer member being positioned between a grounded metallic plate and a probe;

applying a high voltage to the probe;

measuring a mean current value for the applied voltage; and calculating a mean current value per unit area by dividing the measured mean current value by the area of the probe.

3. An image transfer member as claimed in claim 1, wherein the voltage decay time (DT) is measured by the steps of:

the image transfer member being positioned between a grounded metallic plate and a probe;

applying a high voltage to the probe;

instantly cutting off the high voltage applied to the probe after a predetermined length of time has passed; and measuring the voltage for a predetermined length of time after the high voltage has been cut off to calculate the time required until the voltage arrives at a target level.

4. An image transfer member as claimed in claim 1, wherein the surface layer comprises a mixture of an acrylic resin, fluorine and a conductive powder.

5. An image transfer member as claimed in claim 4, wherein the surface layer has a thickness in the range of about 1 to about 20 μm and an elastic modulus in the range of about 50 to about 200 MPa.

6. An image transfer member as claimed in claim 1, wherein the base layer comprises a polyurethane resin and a conductive powder.

7. An image transfer member as claimed in claim 6, wherein the base layer has a thickness in the range of about 100 to about 400 μm and an elastic modulus not less than about 1,000 MPa.

8. An image transfer member as claimed in claim 1, further comprising an elastic layer interposed between the surface layer and the base layer, wherein the elastic layer is formed from polyurethane rubber and a conductive layer.

9. An image transfer member as claimed in claim 8, wherein the elastic layer has a thickness in the range of about 100 to about 400 μm and an elastic modulus in the range of about 1 to about 50 MPa.

10. An image transfer device comprising:

an image transfer member for transferring a developer image between a photoconductor for forming the developer image by using a liquid developer and an image receiving medium;

a first transfer member for applying a first bias voltage to the image transfer member so that the developer image formed on the photoconductor is transferred to the image transfer member; and a second transfer member for a second bias voltage to the image receiving medium so that the developer image transferred to the image transfer member is transferred to the image receiving medium, wherein the image transfer member comprises: a base layer, and a surface layer formed from a semi-conductive material above the base layer to receive the developer image transferred from the photoconductor, the surface layer forming a contact inscribed angle θ in the range of about 10° to about 50° between the surface thereof and the developer image, and wherein the image transfer member has a voltage-current characteristic exhibiting a current density (CD) in the range of about 0.6 $\mu A/cm^2 \leqq CD \leqq 1.5\ \mu A/cm^2$ at about 1 KV voltage, a voltage decay characteristic exhibiting a voltage decay time (DT) in the range of about 0.4 sec≦DT≦3 sec for the voltage decay from about 500 V to about 100 V, and an electric resistance of about 1 to about 100 MΩ between the base layer and the surface layer when a voltage of about 500 V is applied to either the base layer or the surface layer.

11. An image transfer device as claimed in claim 10, wherein the surface layer comprises a mixture of an acrylic resin, fluorine and a conductive powder.

12. An image transfer device as claimed in claim 10, wherein the base layer comprises a polyurethane resin and a conductive powder.

13. An image transfer device as claimed in claim 10, wherein the image transfer member further comprises an elastic layer interposed between the surface layer and the base layer, wherein the elastic layer is formed from a polyurethane rubber and a conductive layer.

14. An image forming system comprising:

an image forming unit comprising:

a developer storage space for storing a liquid developer, a photoconductor for forming an electrostatic latent image, and a developer transferring body rotating in contact with the photoconductor to transfer the liquid developer fed from the developer storage space to the photoconductor in such a way that a visible developer image is formed on the photoconductor according to the electrostatic latent image; and an image transfer unit comprising:

an image transfer member for receiving the developer image transferred from the photoconductor, a first transfer member for applying a first bias voltage to the image transfer member so that the developer image formed on the photoconductor is transferred to the image transfer member, and a second transfer member for a second bias voltage to the image receiving medium so that the developer image transferred to the image transfer member is transferred to the image receiving medium, wherein the image transfer member comprises: a base layer, and a surface layer formed from a semi-conductive material above the base layer to receive the developer image transferred from the photoconductor, the surface layer forming a contact inscribed angle θ in the range of about 10° to about 50° between the surface thereof and the developer image, and wherein the image transfer member has a voltage-current characteristic exhibiting a current density (CD) in the range of about 0.6 $\mu A/cm^2 \leqq CD \leqq 1.5\ \mu A/cm2$ at 1 KV voltage, and a voltage decay characteristic exhibiting a voltage decay time (DT) in the range of about 0.4 sec≦DT≦3 sec for the voltage decay from about 500 V to about 100 V, and has an electric resistance in the range of about 1 to about 100 MΩ between the base layer and the surface layer when a voltage of about 500 V is applied to either the base or the surface layer.

15. An image forming system as claimed in claim 14, wherein the surface layer comprises a mixture of an acrylic resin, fluorine and a conductive powder.

16. An image transfer system as claimed in claim 14, wherein the base layer comprises a polyurethane resin and a conductive powder.

17. An image transfer system as claimed in claim 14, wherein the image transfer member further comprises an elastic layer interposed between the surface layer and the base layer, wherein the elastic layer is formed from a polyurethane rubber and a conductive layer.

* * * * *